United States Patent [19]

Vuilleumier et al.

[11] Patent Number: 4,634,287

[45] Date of Patent: Jan. 6, 1987

[54] UNIVERSAL TIME PIECE

[75] Inventors: Cyril Vuilleumier; Bruno Erni, both of Bienne, Switzerland

[73] Assignee: Tissot S.A., Le Locle, Switzerland

[21] Appl. No.: 768,375

[22] Filed: Aug. 22, 1985

[30] Foreign Application Priority Data

Aug. 23, 1984 [CH] Switzerland ..... 4026/84

[51] Int. Cl.[4] ..... G04B 19/22

[52] U.S. Cl. ..... 368/27; 368/185

[58] Field of Search ..... 368/27, 185

[56] References Cited

U.S. PATENT DOCUMENTS 2,450,264 9/1948 Woodruff ..... 368/27

3,633,354 1/1972 Stemmler .

FOREIGN PATENT DOCUMENTS 284845 8/1952 Switzerland .

515540 7/1971 Switzerland .

563608 6/1975 Switzerland ..... 368/27

*Primary Examiner*—Bernard Roskoski

*Attorney, Agent, or Firm*—Griffin, Branigan, & Butler

[57] ABSTRACT

The timepiece of this invention comprises at least one hand making a revolution in twelve hours and a disc making a revolution in twenty-four hours. A crown enables simultaneous setting of the hand and disc display when pulled out to the second position. When rotated in one sense while in the first pulled-out position the crown sets the disc only. Between the disc and the hand there is interposed a speed reducer provided with a hollowed-out gear containing a jumper spring. The jumper engages a star wheel, itself fixed to a pinion which meshes with teeth borne by the disc. In operating the disc through this mechanism it is displaced through one hour intervals by the action of the end of the jumper on the teeth of the star wheel.

2 Claims, 4 Drawing Figures

UNIVERSAL TIME PIECE

This invention concerns a universal timepiece having an analog display comprising the usual time of day indicators including at least an hours hand making one revolution in twelve hours, a date indicator, a universal time indicator in the form of a disc or hand making one revolution in twenty-four hours and a crown arranged and adapted to assume at least two pulled-out positions relative to a neutral pushed-in position wherein in the first pulled-out position the crown operates a displaceable setting wheel which drives either the date indicator or the universal time indicator, as determined by the sense of rotation of the crown, in order to permit setting of said indicators independently of one another.

BACKGROUND OF THE INVENTION

Swiss Pat. No. 284,845 has already described a universal timepiece comprising, in addition to the usual time of day indicators, a rotatable dial driven by the movement and indicating relative to a fixed dial the time of day in different time zones of the earth. This watch is characterized by an arrangement enabling manual displacement of the rotatable dial independently from the usual time of day indicators, the whole in such a manner as to permit time setting of the rotatable dial. In this system the time setting arrangement includes in addition to a standard crown, an additional push piece intended to cause the rotatable dial to advance by means of a lever and a ratchet gear. Because of friction the displacements of the rotatable dial are not transmitted to the usual time of day indicators. Although it has been indicated that displacement of the rotatable dial may be effected by a crown replacing the push piece, there is nothing said as to how one might go about this in order to put it into practice.

The calendar-watch including two indicating means described in U.S. Pat. No. 3,765,162 is not, properly speaking, a universal timepiece since the hour indicators, which may be dephased relative to one another, each make a revolution in twelve hours, while a true universal timepiece presents, beside the usual hour, minute and second hands, a further hand making one revolution in twenty-four hours. Thus, in this construction, there is very simply provided a sliding coaxial coupling between the two hour wheels. Since a speed reducer is not necessary, the construction is simplified and the problem of correcting the indications is not present in the same manner as in the present invention. Should it be supposed that in the cited arrangement there is a simple speed reducing setting wheel between the indicator 6 and the indicator 7 (see FIG. 2 of the cited document) it will be necessary to arrange the sliding coupling between the indicator 6 fixed to wheel 3 and the teeth borne by this wheel and meshing with setting wheel 12, this leading to a complicated construction.

The observations which have just been made in the preceding paragraph may likewise by applied to U.S. Pat. No. 3,828,546.

Swiss Pat. No. 515.540 describes a timepiece comprising an additional time indicating means. If one of the figures of said patent shows the display of the date through a window in the dial, no explanation has been given as to the setting mechanism thereof from a single crown control which would likewise permit setting of the additional time indicator. Moreover, it must be noted that use has been made in this mechanism of a satellite wheel for driving the additional indicator while in the present invention a speed reducing setting wheel is arranged between first teeth fixed to the universal time indicator and second teeth fixed to the hours hand as will appear subsequently.

The timepiece according to this invention presents from the beginning the characteristics of a true universal timepiece since it possesses an indicator running on twelve hours and a further indicator running on twenty-four hours. The mechanism as provided enables setting of the universal time indicator by the crown and stem alone, and this through steps of one hour, the essential part of the invention residing in the system of the speed reducing gear which permits time setting and indexing of the universal time indicator. To attain this, means as set forth in the claims are employed.

SUMMARY OF THE INVENTION

Thus in the present arrangement the crown may occupy a first and a second pulled-out position and in the first pulled-out position may operate a displaceable setting wheel which drives either the date indicator or the universal time indicator as determined by the sense of rotation of the crown in order to permit setting of said indicators independently of one another and in the second pulled-out position the crown operates the usual time of day indicators and the universal time indicator simultaneously, the speed reducing gear being arranged between first teeth fixed to the universal time indicator and second teeth fixed to the hours hand, said gear including means enabling correction of the universal time indicator alone when the crown is in the first pulled-out position.

DESCRIPTION OF THE PREFERRED EMBODIMENT

Figure 1:
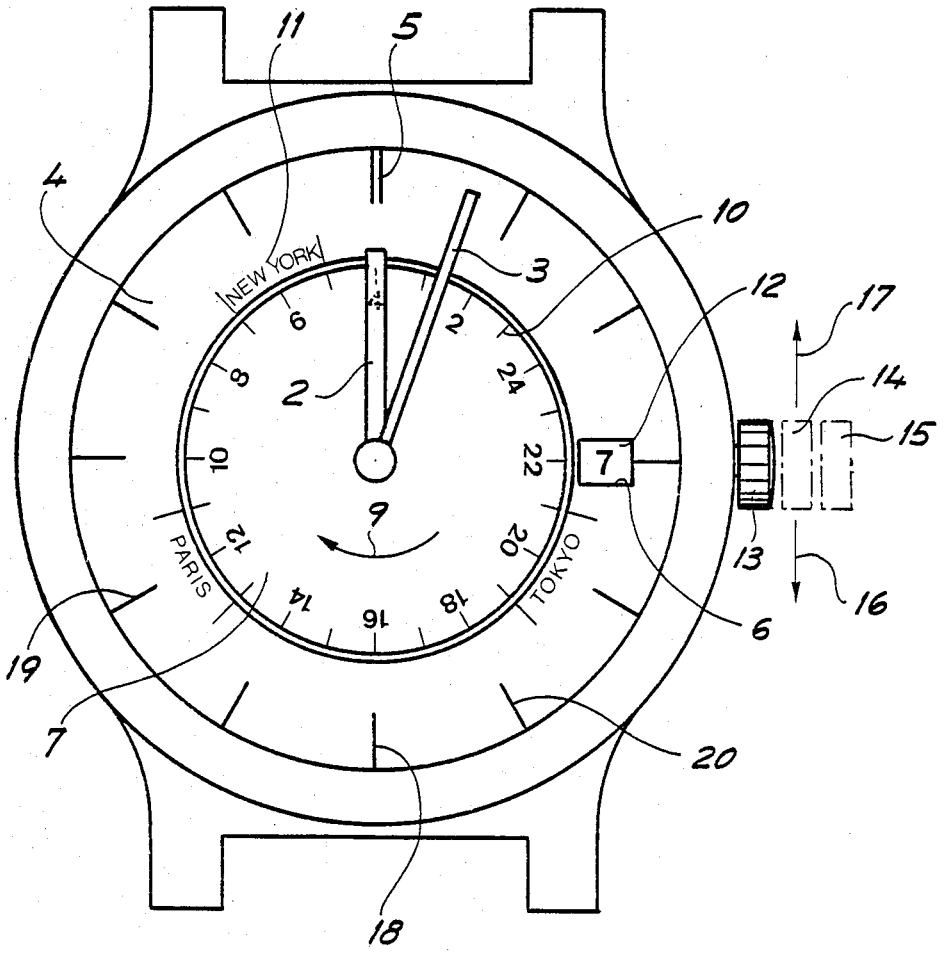
FIG. 1 shows a general aspect of the timepiece according to the invention seen from the dial side.

The timepiece shown on FIG. 1 represents a wristwatch which includes initially the usual time indicators shown here by an hours hand 2 and a minutes hand 3. The hours hand 2 makes one revolution in twelve hours and is displaced over dial 4 provided with twelve hours indices 5. FIG. 1 shows also that the timepiece includes a date indicator 12. Here there is employed a standard known type of date ring with interior teeth and with figures which appear through a window 6. The watch further includes a universal time indicator which in the example shown, comprises a disc 7 which makes one revolution in twenty-four hours. Hand 2 and disc 7 turn in the sense of arrow 9, the first twice as fast as the second.

FIG. 1 shows that the disc 7 bears guide markers 10 numbered from 1 to 24, these markers being displaceable relative to geographical location names 11 placed on the fixed dial 4. As a variant this arrangement could be inverted, that is to say, the fixed dial 4 would bear the markers 10 while on the disc 7 would be placed the location names 11. As a furthr variant the disc 7 could be replaced by a hand making one revolution in twenty-four hours. In this latter case the fixed dial would be extended to the center of the watch and would bear the geographical location names 11.

FIG. 1 shows further that the timepiece is equipped with a crown 13. Said crown may assume two pulled-out positions 14, 15 relative to the pushed-in neutral position as shown. According to the invention, in the first pulled-out position 14 the date indicator 12 is corrected when the crown is turned in the sense of arrow 16 and the universal time indicator 7 when the crown is turned in the sense of arrow 17; this without disturbing the regular display of time given by hands 2 and 3. In the second pulled-out position 15, the crown operates simultaneously disc 7 and hands 2 and 3 in one sense or in the other according to the sense of rotation of said crown.

If reference is made to the position of the time indicators such as shown on FIG. 1, it will be seen that if it is noon in Paris as appears from the position of hand 2, it is 6 o'clock in New York, twenty hours in Tokyo and twelve hours in Paris, as may be evident from reading disc 7. The system of time indicators is thus regulated for a resident of Paris who will at all times know the local time at his residence (by means of hands 2 and 3) and the time of day in different geographical locations (by means of the universal disc 7). It is to be noted that in order not to overload the drawing three names ony of capital cities have been shown on the dial. In actuality, the watch may contain up to twenty-four different names marking thus the twenty-four time zones of the earth.

It will now be seen from an example how one proceeds in time setting the watch consequent on a trip. If the traveller goes from Paris to New York (which is six hours behind the time in Paris), he will pull out the crown to the second position 15, set back hand 2 in the counter clockwise sense from marker 5 where it will now be found opposite marker 18 ( six hours). In effecting this operation, disc 7 will also have turned back through six hours bringing for example the indication twelve hours of disc 7 (which initially faces marker 19) facing marker 20. Once this operation has been completed he will push the crown into the first pulled-out position 14 and then will turn the crown in the sense of arrow 17 which will rotate disc 7 alone in the clockwise sense (arrow 9). He will stop this rotation when the indication twelve hours borne by disc 7 is again found facing marker 19 of dial 4. In this new situation, hand 2 indicates local time which is that of New York (six o'clock). Finally, the last operation will be that of returning the crown to its neutral pushed-in position.

To realize the functions which have just been described, the timepiece according to the invention includes on the one hand a switching system operated according to the sense of rotation of the crown and on the other hand a speed reducing gear comprising means acting selectively on the universal time indicator. These elements will now be described having reference to FIGS. 2, 3 and 4.

Figure 2:
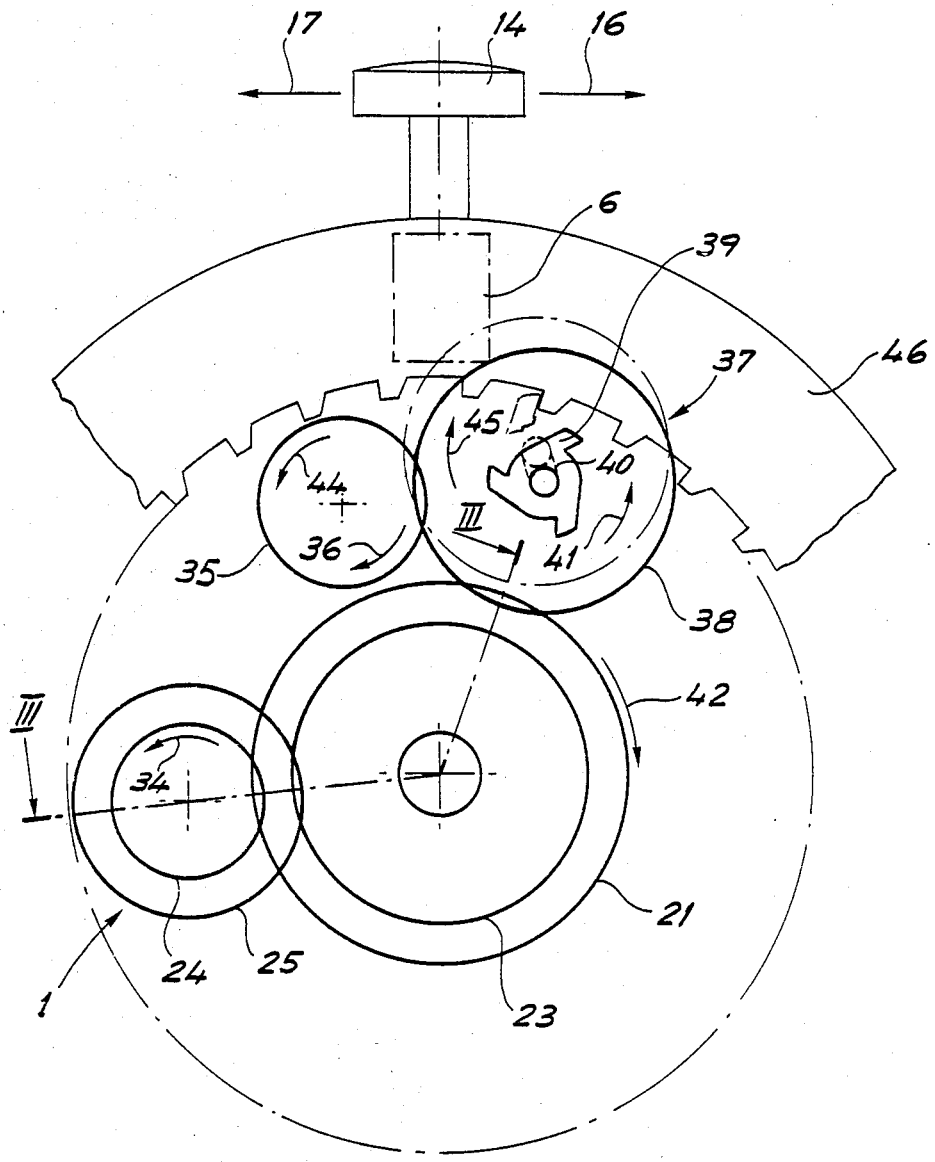
FIG. 2 is a plan view of the time setting mechanism for the indicators of the timepiece shown in FIG. 1, the dial and the indicators themselves having been removed.
Figure 3:
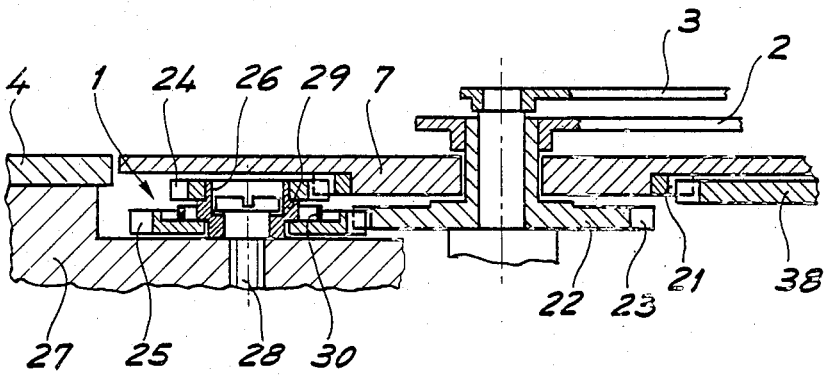
FIG. 3 is a cross-section along line III—III shown on FIG. 2.

FIG. 2 is a plan view of the time setting mechanism when the dial 4 and the disc 7 shown on FIG. 1 have been removed and FIG. 3 is a cross-section along line III—III of FIG. 2. If reference is made more particularly to FIG. 3, it will be seen that the universal time indicator is shown in the form of disc 7. On this disc will be found first teeth 21 shown on FIG. 2 by the overall diameter. On FIG. 3 may likewise be seen the usual time indicators for hours 2 and minutes 3. Fixed to the hours hand 2 is the cannon wheel 22 provided with second teeth 23 also shown on FIG. 2 by the overall diameter. The cannon wheel receives its rotational movement via a classical dial train which has not been shown and which causes it to make one revolution in twelve hours. A speed reducing setting mechanism is arranged between teeth 23 and teeth 21. This mechanism comprises a pinion 24 and a gear 25 which are shown on FIG. 2 by their overall diameter. The gear ratios of teeth 23, 25, 24 and 21 are chosen in a manner such that disc 7 makes one revolution in twenty-four hours. The setting mechanism 1 comprises means permitting the correction of the universal indicator alone when the crown is disposed in a particular axial position as will be explained hereinafter.

Figure 4:
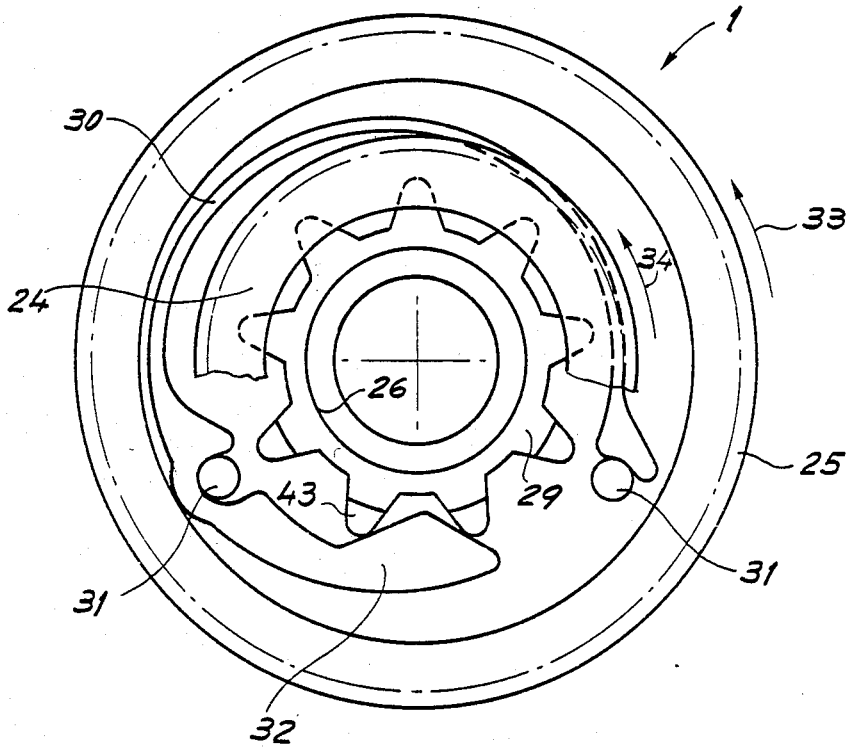
FIG. 4 is a plan view to an enlarged scale of the speed reducing gear bearing reference 1 on FIG. 3.

According to a preferred variant of the invention and with reference more particularly to FIGS. 3 and 4, the reducing setting mechanism includes a boss 26 pivotally mounted on base plate 27 of the timepiece by means of screw 28. Fixed to this boss is a star wheel 29 and pinion 24 which is only partially represented on FIG. 4. Pinion 24 meshes with teeth 21 of disc 7. As may be seen on FIG. 3, the setting mechanism 1 further includes a hollowed out gear 25 which is pivotally mounted on boss 26. In the hollowed out portion of gear 25 is placed a jumper spring 30 held in place by two pins 31. The end 32 of jumper spring 30 engages with the star wheel 29. Gear 25 meshes with teeth 23 of the cannon wheel 22. In normal operation of the watch, the cannon wheel 22 is driven in the clockwise sense by motor means (not shown) and causes the gear 25 to turn in the sense of arrow 33. The end 32 of jumper 30 drives the star wheel 29 and pinion 24 which is fixed thereto in the sense of arrow 34. Disc 7 is thereby driven in the closkwise sense by its teeth 21 meshing with pinion 24. In normal operation the crown 13 is in its pushed-in neutral position (see FIG. 1). An analogous situation is presented when the crown is placed in its second pulled-out position 15. In this position one may operate on the cannon wheel by a time-setting mechanism known to the state of the art and not shown here. When one turns the crown in one or the other sense, one effects time setting either by advancing or by turning back the usual time indicators and the universal time indicator simultaneously.

It will now be explained how, in accordance with the invention, one may proceed to set the universal time indicator disc alone or the calendar alone, according to the sense of rotation of the crown.

The crown is placed in the first pulled-out position 14 (see FIG. 2). In this position, the crown drives via a sliding and locking lever mechanism, known to the art, a wheel 35 which turns in the sense of arrow 36 if the crown is turned in the sense of arrow 17. Wheel 35 is in mesh with the displaceable gear 37 which includes teeth 38 and a pinion having three leaves 39. The axis of gear 37 is guided in an oblong hole 40 in a manner such that if the wheel 35 turns in the sense of arrow 36 the gear 37 will be urged to the low position shown on the drawing. The teeth 38 will then come into mesh with teeth 21 of disc 7 as may be seen also on FIG. 3. The teeth 38 turn in the sense of arrow 41 and the disc will be set in the clockwise sense shown by arrow 42. Teeth 21 of disc 7 drive the pinion 24 of the speed reducing setting mechanism 1 in the sense of the arrow 34 (see FIG. 4) as well as the star 29 which is fixed thereto. As wheel 25 is fixed, retained as it is by the wheel train and the motor means, tooth 43 of star 29 will lift the end 32 of jumper spring 30 which will arrive in the position of the next tooth space of the star.

According to a preferred version of the invention the number of teeth of the star 29 is calculated in order to have the disc 7 advance by steps of one hour when the crown is operated. This positioning will be touch-sensitive since the end of the jumper spring will be stopped by the space between two teeth of the star and thus assure good positioning. In a practical example, the disc 7 has seventy-two teeth and pinion 24 which meshes therewith twenty-seven teeth. In these conditions in order to have disc 7 advance through one hour (rotation of 15%), it will be necessary to provide a stop position of the star every $$(72 \cdot 15°)/27 = 40 \text{ degrees}$$

this leading to a star having 9 leaves as shown on FIG. 4. This system of stop by intervals on one hour in addition to positioning exactly the twenty-four hour indicating organ presents a further advantage: that of relaxing the setting of the date. Effectively, if the reducing setting mechanism employed simple friction as described in Swiss Pat. No. 284.845 hereinabove mentioned, the twenty-four hour disc when brought into a new position would effect a slight return in reverse when the crown was pushed into its neutral position.

If now the crown, positioned in its first pulled-out position, is turned in the sense of arrow 16, wheel 35 will turn in the sense of arrow 44, and the displaceable wheel 37 will turn in the sense of arrow 45 which will urge it to occupy the dotted upper position shown on FIG. 2. At this moment the leaves of pinion 39 will come into mesh with the teeth of the crown of date disc 46 which will enable setting the date appearing in window 6.

The invention is not limited to universal time display by means of disc 7. Such disc could be replaced by a hand making one revolution in twenty-four hours. In an arrangement of this type, the dial 4 would be extended to the center of the timepiece (see FIG. 3). Surrounding the axis of the cannon wheel 22, one would then have a second cannon bearing on one side the twenty-four hour hand and on the other under the dial a wheel coming into mesh with the reducing setting mechanism.

What we claim is:

1. A universal timepiece having an analog display comprising the usual time of day indicators including at least an hours hand making one revolution in twelve hours, a date indicator, a universal time indicator in the form of a disc or hand making one revolution in twenty-four hours and a crown arranged and adapted to asume at least two pulled-out positions relative to a neutral pushed-in position wherein in the first pulled-out position the crown operates a displaceable setting wheel which drives either the date indicator or the universal time indicator as determined by the sense of rotation of the crown in order to permit setting of said indicators independently of one another and in the second pulled-out position the crown drives the usual time of day indicators and the universal time indicator simultaneously, a speed reducing setting mechanism being arranged between first teeth fixed to the universal time indicator and second teeth fixed to the hours hand, said setting mechanism including a boss pivotally mounted on the timepiece base plate, a star wheel and a pinion both fixed to said boss, said pinion meshing with said first teeth and a hollowed-out gear mounted on said boss and rotatable relative thereto, said hollowed-out gear meshing with said second teeth and bearing a jumper spring in its hollowed-out portion arranged to engage with said star wheel.

2. A universal timepiece as set forth in claim 1 wherein the star wheel bears a number of teeth such that the universal time indicator advances through steps of one hour when the crown is operated to set said universal time indicator.

* * * * *